United States Patent [19]

Rasmussen

[11] Patent Number: 4,509,296

[45] Date of Patent: Apr. 9, 1985

[54] RADIAL BELT GRINDER

[76] Inventor: Aaron P. Rasmussen, 9606 Candy La., La Mesa, Calif. 92041

[21] Appl. No.: 360,607

[22] Filed: Mar. 22, 1982

[51] Int. Cl.[3] ..... B24B 21/00

[52] U.S. Cl. ..... 51/148; 51/141; 51/147; 269/74; 310/91; 474/138

[58] Field of Search ..... 51/124 L, 135 R, 135 BT, 51/141, 147, 148, 170 EB; 269/74, 76; 83/818; 198/814; 474/135, 138; 310/42, 91

[56] References Cited

U.S. PATENT DOCUMENTS

| | | | |
|---|---|---|---|
| 1,374,643 | 4/1921 | Fischbach | 474/138 |
| 2,463,287 | 3/1949 | Krueger | 51/135 R |
| 2,470,615 | 5/1949 | Grover | 51/148 X |
| 2,624,158 | 1/1953 | Hendrickson | 51/148 X |
| 2,633,675 | 4/1953 | Ellis | 51/124 L |
| 2,747,421 | 5/1956 | Thiel | 51/135 R |
| 3,436,979 | 4/1969 | Molitor | 474/138 |
| 3,534,508 | 10/1970 | Del Vecchio | 51/170 EB X |
| 3,643,385 | 2/1972 | Mikiya | 51/170 EB |
| 3,664,208 | 5/1972 | Saito | 51/170 EB X |

FOREIGN PATENT DOCUMENTS

| | | | |
|---|---|---|---|
| 936617 | 11/1955 | Fed. Rep. of Germany | 51/148 |
| 534616 | 3/1922 | France | 51/170 EB |

*Primary Examiner*—Robert P. Olszewski

*Attorney, Agent, or Firm*—Charles C. Logan, II

[57] ABSTRACT

A radial belt grinder having a drive wheel and a camber adjustable idler wheel coupled by a housing assembly. The housing assembly is rotatably supported on a machine radial groove by four shoulder bolts which also function to attach a C-framed motor to the base ring plate. A closed loop abrasive belt is transported about the wheels to accomplish multiple position platen and contour wheel grinding. An anti-recoil control mechanism facilitates belt exchanges and limits pressure recoil when the idler wheel is used in tilt angle, contour wheel grinding. A universal work rest arm, centrally supported at the rear of the housing assembly, provides the structure to adjustably support the work piece in infinite radial work positions through 180 degrees. A quick set friction lock functions to secure the rotatable housing at a selected radial angle. The work rest and all guards are reversable to accommodate left or right hand machine operations.

6 Claims, 6 Drawing Figures

RADIAL BELT GRINDER

BACKGROUND OF THE INVENTION

The invention relates to grinding machines, and more particularly to such machines of the type using a closed loop abrasive belt.

In the past, radial belt grinders have been known but these have exhibited a lack of certain capabilities. Although they have been tiltable through a limited range, they have not been capable of being tilted through a usuable range of 180 degrees. This was primarily due to the type of mounting structure used by previous belt grinders. Additionally the mechanism for locking the radial belt grinder in any particular angular position has required more time than was desirable. Previous radial belt grinders also lack the versatility in a single machine for either left or right handed operation.

It is an object of the invention to provide a novel radial belt grinder having a 180 degree range of useful radial grinding positions with a minimum of machinery and inconvenience.

It is also an object of the invention to provide a novel radial belt grinder having a simple and rapid structure for locking in a desired radial work position.

It is an object of the invention to provide a novel radial belt grinder having an effective mechanism for tensioning the abrasive belt and for accomplishing easy belt replacement.

It is also an object of the invention to provide a novel radial belt grinder having structure for controlling pressure recoil to permit contour grinding with the lateral idler wheel.

It is also an object of the invention to provide a novel radial belt grinder having a universal work rest with infinite position changes to accomodate the 180 degree rotation of the grinding assembly.

It is another object of the invention to provide a novel radial belt grinder having simple but positive means for controlling camber and belt tracking.

It is an additional object of the invention to provide a novel radial belt grinder having the versatility of left or right handed operation in a single machine.

It is a further object of the invention to provide a novel radial belt grinder having a system of interchangeable guards for protection of the operator from unnecessary abrasive exposure.

SUMMARY OF THE INVENTION

Applicant's novel radial belt grinder has a drive motor having a drive shaft extending from its one end. To that end of the motor is attached a ring mount which in turn is attached to the supporting structure for the radial belt grinder. A drive wheel is mounted on the drive shaft and it is surrounded by a housing assembly having a radial plate that forms the rear wall of the housing assembly. The radial plate has a cut-out portion in its inner area that provides an arcuate inner edge surface that functions as a guide surface during rotation of the radial plate. A plurality of shoulder bolts are fastened to the ring mount plate at spaced intervals around the arcuate inner edge surface with the lateral surface of the shank portions of these shoulder bolts bearing against the arcuate inner edge surface of the radial plate. The housing assembly is thus rotatable about the ring mount through a workable range of 180 degrees. A set position-locking system is provided for locking the housing assembly in any desired radial work position.

The novel radial belt grinder also has a unique structure for accomplishing the tensioning of the abrasive belt and for also accomplishing easy belt replacement. Additional structure is coordinated with the abrasive belt tensioning structure for controlling the pressure recoil thereby permitting contour grinding with the lateral idler wheel. Unique structure is also utilized for supporting the idler wheel and providing it with a simple but positive mechanism for controlling camber and belt tracking.

The work rest and all guards are reversible to accomodate left or right hand machine operations.

DESCRIPTION OF THE PREFERRED EMBODIMENT

Figure 1:
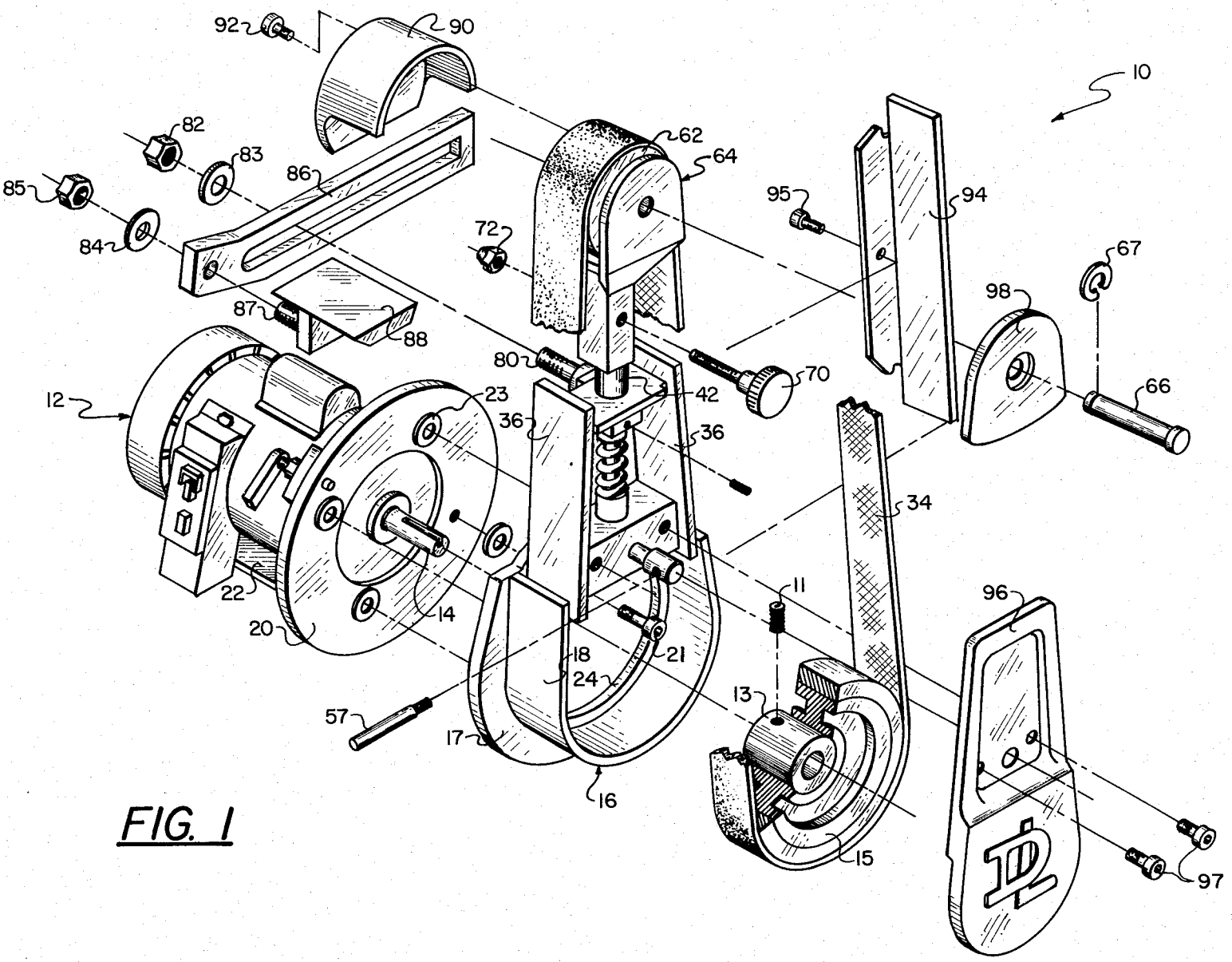
FIG. 1 is a front perspective view of the novel radial belt grinder with the components illustrated in an exploded view.
Figure 2:
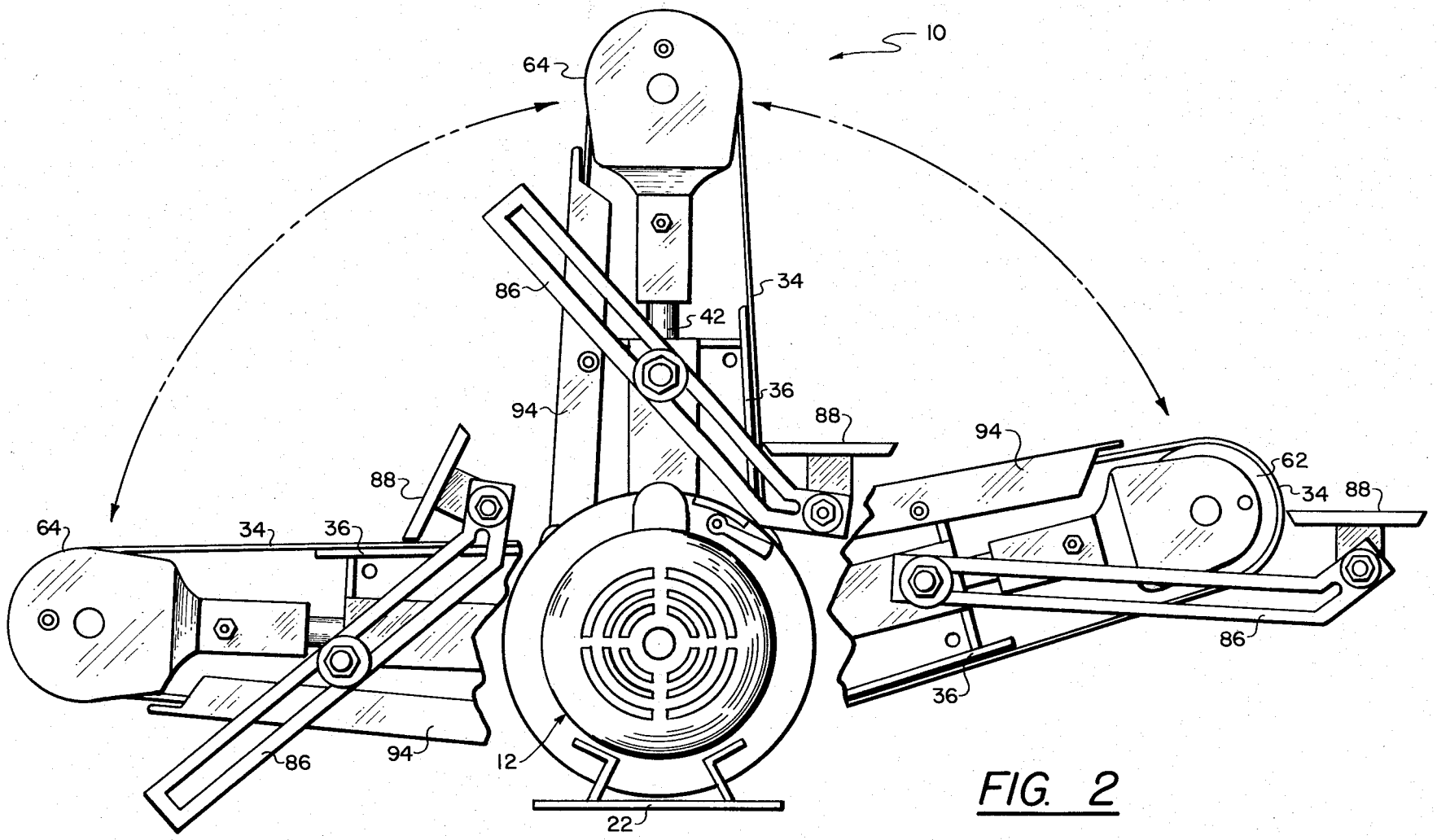
FIG. 2 is a rear elevation view illustrating the novel radial belt grinder in various positions within its 180 degree range of working positions.
Figure 6:
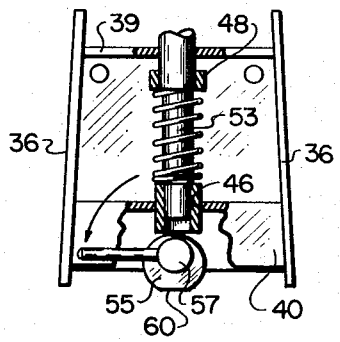
FIG. 6 is a partial front elevation view of the radial belt grinder illustrating the spring/cam mechanism in the compression release position.
Figure 3:
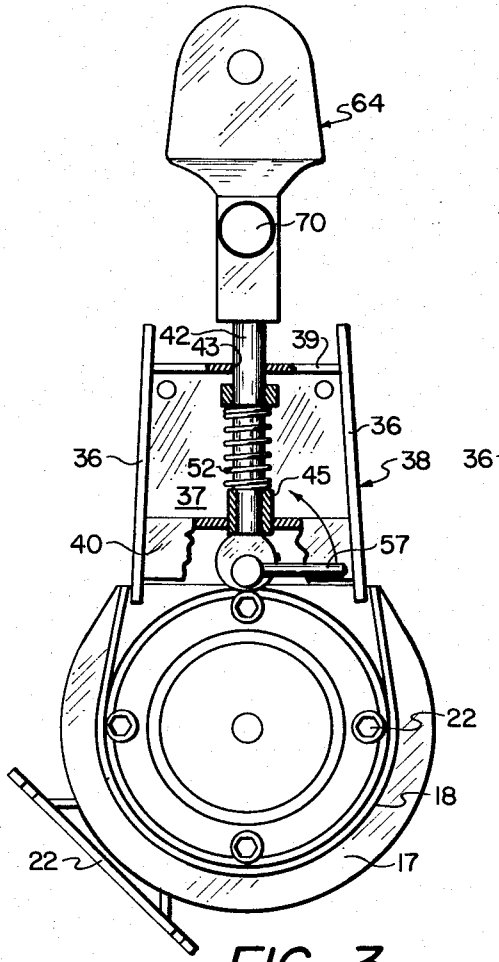
FIG. 3 is front elevation view of the radial belt grinder with its panel cover removed thereby illustrating the spring cam mechanism in a limited recoil position.

The novel radial belt grinder will now be described by referring to FIGS. 1–6. The radial belt grinder is generally designated numeral 10. It has a drive motor 12 having a drive shaft 14 and a drive wheel 15 is mounted on the drive shaft. A drive wheel housing assembly 16 is formed from radial plate 17 and a shroud wall 18 that extends outwardly from the radial plate and which surrounds a major portion of the perimeter of drive wheel 15.

Ring mount 20 is weldment attached in perpendicular orientation to base 22. Housing assembly 16 is rotatably supported on ring mount 20 by four shoulder bolts 21 which provide containment points in bearing contact with concentric arcuate inner edge surface 24 during rotation of radial plate 17. Shoulder bolts 22 also function to fasten drive motor 12 to ring mount 20 and attached base 22. Four nylon spacer washers 23 operate to reduce friction and limit noise transfer between the rotational surface of radial plate 17 and the face of stationary ring mount 20.

Figure 5:
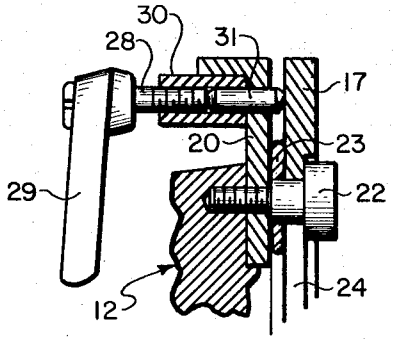
FIG. 5 is an enlarged sectional view from FIG. 4 detailing the friction lock and radial mounting assemblys.
Figure 4:
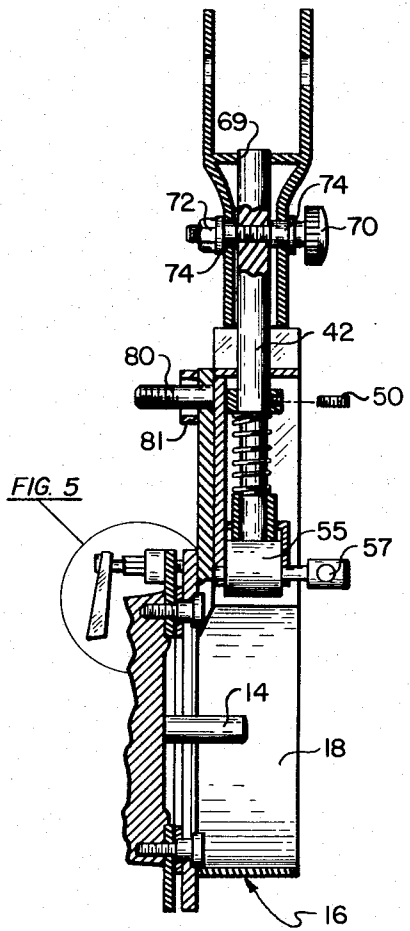
FIG. 4 is a side elevation view of the radial belt grinder with a portion in cross sectional view.

The frictional locking system for holding the drive wheel housing assembly in any particular angular position is illustrated in FIG. 5. The stud 28 of a commercial ratchet handle 29 engages the threads of coupler nut 30 to bear on friction pin 31 which penetrates ring mount 20 to bear on the revolving surface of radial plate 17. Clockwise rotation of handle 29 depresses the pin and locks the drivewheel housing assembly in a selected operating position. Clockwise rotation releases braking pressure and permits radial movement of the drivewheel housing assembly.

Drive wheel 15 is press fit to hub 13 which is locked to motor drive shaft 14 by set screw 11. Drivewheel 15 is crowned to drive abrasive belt 34. Enclosing and protecting the operator from drivewheel 15 and belt 34 is shroud 18, which comprises a portion of the drivewheel housing 16. Drive wheel housing 16 also supports a pair of laterally positioned surface platens 36 which act as backing plates for support of closed loop abrasive belt 34.

Platens 36 also form part of the structure of a middle frame assembly 38. The rear edges of platens 36 are attached to rear wall plate 37. Forming the top end and bottom end of the middle frame assembly are respectively, surface plate 39 and angle member 40.

Idler support bar 42 is telescopically received through a bored hole 43 in surface plate 39 at the top of middle frame assembly and is reciprocally contained within sleeve bushing 45. Sleeve bushing 45 is set within, and forms a sliding fit with, the bored hole 46 in angle member 40. Guide stop 48 is rectangular in shape and forms a bearing surface with the rear wall 38 of middle frame assembly 38. When set screw 50 is locked to support bar 42, guide stop 48 eliminates rotation and limits the reciprocal travel of support bar 42.

Compression spring 52 slides over a machine reduced length portion 53 of idler support bar 42 its extension limits are determined by guide stop 48 and sleeve bushing 45.

Cam 55 is rotatably supported by cam shaft 56 which revolves within the bored holes of angle member 40 and rear wall plate 38 of middle frame assembly 38. Cam 55 is locked on shaft 56 by a set screw. Cam handle 57 is threaded into cam 56 to provide rotational leverage. Cam 55 engages sleeve bushing 45 when cam handle 57 is at the nine o'clock position. At this position, idler support bar 42 has approximately ½ inch of free compression travel, and spring 52 is at minimal compression. These conditions permit the hand depression of idler bar 42 as a means for the exchange of closed loop abrasive belts 34. Clockwise rotation of cam handle 57 to the three o'clock position produces cam lift, and increase in spring compression, and contact between cam 55 and the end surface of idler support bar 42. At this position, the extension of spring 52 is contained only by the counter tension of the abrasive belt, but compression is limited by intimate contact between cam 55 and support bar 42. During operation, the three o'clock cam position is stabilized by sleeve pressure on a slight flat surface 60 machined on cam 55. The design of the cam tension assembly was developed to facilitate belt exchanges and to limit recoil when working pressures are applied to the idler wheel 62 during contouring operations.

Idler support bar 42 functions to support idler case 64 which houses components on the idler head. Idler case 64 suspends idler axle 66 and clip 67 which rotatably carry idler wheel 62 and closed loop abrasive belt 34.

Support bar 42 is pivotally engaged in hole 69 of the idler case and is supported by thumbscrew 70. Thumbscrew 70 is threaded through the support bar 42, and is laterally adjusted by lock nut 72 to rotate in fixed axial position with the flange bushings 74 penetrating idler case 64. Thus, rotation of thumbscrew 70 produces camber adjustment of the idler case and idler wheel 62 which influences the tracking alignment of closed loop abrasive belt 34.

Attached by weldment to the rear of middle frame assembly 38 is stud 80 and spacer ring 81, which act in concert with nut 82 and flat washer 83 to lock work workrest arm 86 in any of an infinite number of positions to accomodate the 180 degree movement of the radial grinder assembly 10. Adjustably fastened to the workrest arm 86 is workrest 88 by threaded stud 87 and washer 84 and nut 85. Workrest 88 serves to support the work piece during platen and contour grinding.

Guarding the abrasive belt pathway is idler head guard 90, removable for contour work by removing screw 92 from the rear of idler case 64. Belt guard 94 is reversable for right or left hand operation by removing screw 95 from the rear wall of middle frame assembly 38. Panel cover 96 encloses drivewheel 62, drivewheel housing 16, and middle frame assembly 38. Cover plate 96 is held in position by two screws 97 threaded into the face of angle 40. Completing the assembly is cosmetic facing 98 on the front of idler case 64.

What is claimed is:

1. A radial belt grinder comprising:

a drive motor having a drive shaft;

a drive wheel mounted on said drive shaft;

a housing assembly for said drive wheel;

an idler wheel;

an idler wheel support bar having an upper and bottom end;

means for supporting said idler wheel laterally spaced from said housing assembly comprising a middle frame assembly having one end connected to said drive wheel housing assembly, an other end having the bottom end of said idler wheel support bar extending from it, an idler wheel case being supported on the upper end of said idler wheel support bar, said idler wheel case having bifurcated supporting arms that receive the end of an axle supporting said idler wheel;

a closed loop abrasive belt passing around the perimeter of said drive wheel and said idler wheel;

means for allowing the bottom end of said idler support bar to telescope within said middle frame assembly a predetermined distance sufficient to mount and remove said closed loop abrasive belt comprising said middle frame assembly having a surface plate extending transversely to said idler wheel support bar and having a bored hole through which said idler wheel support bar passes; following in axial sequence on said idler support bar after passing through said bored hole there being a guide stop, a compression spring, and a sleeve bushing; said sleeve bushing being telescopingly mounted in the bottom end of a transversely extending angle member that forms part of said middle frame assembly;

a cam shaft extending transversely to the lower end of said idler wheel support bar and having opposite ends journaled in said middle frame assembly, a cam being mounted on said cam shaft and said cam bearing against a lower end of said sleeve bushing, a cam handle being attached to said cam for rotating it between a position facilitating belt exchanges and a position limiting recoil when working pressures are applied to said idler wheel during contouring operations; and means for rotating said housing assembly with respect to said drive motor to various radial work positions.

2. A radial belt grinder as recited in claim 1 wherein said housing assembly comprises a radial plate that forms a rear wall, and a shroud wall extending outwardly from said radial plate that surrounds a major portion of the perimeter of said drive wheel.

3. A radial belt grinder as recited in claim 2 wherein said means for rotating said housing assembly with respect to said drive motor comprises:

a ring mount secured to the drive shaft end of said drive motor;

said radial plate having a cut-out portion in its inner area that provides an arcuate inner edge surface that functions as a guide surface during rotation of said radial plate, a plurality of shoulder bolts are fastened to said ring mount plate at spaced intervals around said arcuate inner edge surface with the lateral surface of their shank portion bearing against said arcuate inner edge surface.

4. A radial belt grinder as recited in claim 3 further comprising quick-set friction locking means for locking said radial plate at various radial positions when rotated with respect to said ring mount.

5. A radial belt grinder as recited in claim 4 wherein said radial plate is capable of at least 180 degrees of travel with respect to said ring mount.

6. A radial belt grinder as recited in claim 1 further comprising camber adjustment means for said idler wheel which influences the tracking alignment of said closed loop abrasive belt.

* * * * *